US011567522B2

(12) United States Patent
Chang et al.

(10) Patent No.: US 11,567,522 B2
(45) Date of Patent: Jan. 31, 2023

(54) VOLTAGE REFERENCE BUFFER CIRCUIT

(71) Applicant: REALTEK SEMICONDUCTOR CORPORATION, Hsinchu (TW)

(72) Inventors: Che-Wei Chang, Taipei (TW); Kai-Yin Liu, Hsinchu (TW); Liang-Huan Lei, Kaohsiung (TW); Shih-Hsiung Huang, Miaoli County (TW)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 0 days.

(21) Appl. No.: 17/405,380

(22) Filed: Aug. 18, 2021

(65) Prior Publication Data

US 2021/0382512 A1 Dec. 9, 2021

Related U.S. Application Data

(62) Division of application No. 15/800,935, filed on Nov. 1, 2017, now abandoned.

(30) Foreign Application Priority Data

Nov. 15, 2016 (TW) ..... 105137176

(51) Int. Cl.
*H02H 7/00* (2006.01)
*H02H 9/00* (2006.01)
(Continued)

(52) U.S. Cl.
CPC ..... *G05F 1/618* (2013.01); *G05F 1/40* (2013.01); *G05F 1/571* (2013.01); *G05F 1/573* (2013.01); *G05F 1/575* (2013.01); *G05F 3/247* (2013.01)

(58) Field of Classification Search
CPC . G05F 1/561; G05F 1/618; G05F 1/56; G05F 1/571; G05F 1/40; G05F 1/575
(Continued)

(56) References Cited

U.S. PATENT DOCUMENTS 5,864,227 A 1/1999 Borden et al.
6,037,811 A 3/2000 Ozguc
(Continued)

FOREIGN PATENT DOCUMENTS

CN 1757157 A 4/2006
CN 101588172 A 11/2009
(Continued)

OTHER PUBLICATIONS

Tseng et al. "A 12-bit 104 MS/s SAR ADC in 28 nm CMOS for Digitally-Assisted Wireless Transmitters", 2016, IEEE Journal of Solid-State Circuits.

*Primary Examiner* — Jared Fureman
*Assistant Examiner* — Lucy M Thomas
(74) *Attorney, Agent, or Firm* — WPAT, PC

(57) ABSTRACT

Disclosed is a voltage reference buffer circuit including a first, second, third, and fourth bias generators and a first, second, third, and fourth driving components. The first, second, third, and fourth bias generators generate bias voltages to control the first, second, third, and fourth driving components respectively. The first, second, third, and fourth driving components are coupled in sequence, wherein the first and second driving components are different types of transistors and jointly output a first reference voltage, the third and fourth driving components are different types of transistors and jointly output a second reference voltage, and the group of the first and second driving components is separated from the group of the third and fourth driving components by a resistance load.

8 Claims, 10 Drawing Sheets

(51) Int. Cl.

| | |
|---|---|
| ***G05F 1/618*** | (2006.01) |
| ***G05F 3/24*** | (2006.01) |
| ***G05F 1/575*** | (2006.01) |
| ***G05F 1/571*** | (2006.01) |
| ***G05F 1/573*** | (2006.01) |
| ***G05F 1/40*** | (2006.01) |

(58) Field of Classification Search
USPC ..... 361/18; 327/536, 537
See application file for complete search history.

(56) References Cited

U.S. PATENT DOCUMENTS

| | | | | |
|---|---|---|---|---|
| 6,201,375 | B1 | 3/2001 | Larson et al. | |
| 6,333,623 | B1 | 12/2001 | Heisley et al. | |
| 7,002,401 | B2 | 2/2006 | Khalid | |
| 7,221,213 | B2 | 2/2007 | Lee et al. | |
| 7,450,354 | B2 | 11/2008 | Tain et al. | |
| 7,924,087 | B2 * | 4/2011 | Tu | H03K 19/018528 327/543 |
| 8,072,198 | B2 | 12/2011 | Imura | |
| 9,141,121 | B2 | 9/2015 | Nihei et al. | |
| 9,236,732 | B2 | 1/2016 | Matsuda et al. | |
| 9,323,258 | B2 | 4/2016 | Nakashimo et al. | |
| 9,385,718 | B1 * | 7/2016 | Liu | H03K 19/01721 |
| 2009/0315531 | A1 | 12/2009 | Liao et al. | |

FOREIGN PATENT DOCUMENTS

| | | |
|---|---|---|
| TW | 201537893 | 10/2015 |
| WO | WO2004070944 A1 | 8/2004 |

* cited by examiner

VOLTAGE REFERENCE BUFFER CIRCUIT

BACKGROUND OF THE INVENTION

1. Field of the Invention

The present invention relates to a buffer circuit, especially to a voltage reference buffer circuit.

2. Description of Related Art

The design of a voltage reference buffer affects the precision of a reference voltage and the time for establishing the reference voltage. Furthermore, the design also affects the signal-to-noise ratio (SNR) and the settling speed of a voltage reference reception circuit, and affects the power consumption and the size of circuit area of the voltage reference buffer itself.

Generally, at the reference voltage output terminal of a general voltage reference buffer is set a single driving component. For such voltage reference buffer, the driving capability, especially the capability of current sink, is weak. An example of this kind of voltage reference buffer is found in the following literature: Wei-Hsin Tseng, Wei-Liang Lee, Chang-Yang Huang, and Pao-Cheng Chiu, "A 12-bit 104 MS/s SAR ADC in 28 nm CMOS for Digitally-Assisted Wireless Transmitters", *IEEE JOURNAL OF SOLID-STATE CIRCUITS.*

Another kind of current arts is a low dropout regulator (LDO) which is a common DC-DC regulator. The output voltage of an LDO is compared with an input voltage through a negative feedback mechanism in a system, so that the provision of current for an output transistor is controlled, and a stable DC voltage is provided. However, generally, when the input voltage or a load of the LDO changes rapidly, under the restriction of a limited loop bandwidth of the aforementioned negative feedback mechanism, the aforementioned output transistor cannot respond to the rapid change immediately, then a transient response of the output voltage of the LDO is raised, and thus the output voltage changes suddenly. This transient change of the output voltage may damage the system; for instance, when the output voltage goes too high, it may damage the components in a following stage of the system, and when the output voltage goes too low, it may affect the normal operation of the following stage. In consideration of the above-mentioned problems, the LDO should have an overvoltage protection function to prevent the surge of the output voltage. Therefore, some LDO uses a voltage detection circuit to detect a rapid change of the input voltage or the load, so as to turn on a discharge circuit when detecting such rapid change. For instance, the comparator $C_1$ in FIG. 2 of a US patent (U.S. Pat. No. 5,864,227; hereafter, '227 patent) is configured to detect an overvoltage and the transistor $MP_D$ is configured to discharge current when the overvoltage is detected ('227 patent: col. 2, line 52-col. 3, line 5); it should be noted that the output transistor $MP_X$ and the transistor $MP_D$ in FIG. 2 of '227 patent are the same type of transistor (i.e., PMOS). For another instance, the overvoltage comparator 9 in FIG. 2 of another US patent (U.S. Pat. No. 6,201,375; hereafter, '375 patent) is configured to detect whether the output voltage $V_{OUT}$ is at an overvoltage level, and to turn on a discharge transistor 10, if necessary ('375 patent: col. 5, line 41-col. 6, line 19); it should be noted that the output transistor 4 and the discharge transistor 10 in FIG. 2 of '375 patent are the same type of transistor (i.e., NMOS). People who are interested in LDO may refer to the US patents by the following U.S. Pat. Nos. 7,221,213; 7,450,354; 8,072,198; 9,141,121; 9,236,732; and 9,323,258.

In light of the above, although some LDO uses two transistors of the same type at a voltage output terminal, one of the transistors (e.g., the aforementioned transistor $MP_D$ or the discharge transistor 10) is only turned on when an overvoltage occurs; therefore this transistor is not able to source current to a load terminal or sink current from the load terminal during a normal operation. As a result, this kind of LDO is by no means to improve its driving capability through additional transistors.

A further kind of current arts is an inverter type of power amplifier, which includes a transistor at a high voltage terminal, a transistor at a low voltage terminal, a voltage input terminal connecting the gates of the above-mentioned two transistors, and a voltage output terminal connecting the sources of the two transistors. Although this kind of power amplifier uses two transistors at the voltage output terminal, one of the transistors at the high voltage terminal is turned on when an input signal is low, and the other transistor at the low voltage terminal is turned on when the input signal is high; as a result, the two transistors will not be turned on at the same time for providing driving assistance. Therefore, this kind of power amplifier improves driving capability in no way. It should be noted that the above-mentioned two transistors are controlled by the same input signal, i.e., the same signal bias voltage.

SUMMARY OF THE INVENTION

An object of the present invention is to provide a voltage reference buffer circuit using a plurality of driving components for enhancing driving capability.

An embodiment of the voltage reference buffer circuit of the present invention includes a first bias generator, a first driving component, a second bias generator, a second driving component, a third bias generator, a third driving component, a fourth bias generator, and a fourth driving component. The first bias generator is for generating a first bias voltage. The second bias generator is for generating a second bias voltage different from the first bias voltage. The first driving component is coupled to a high voltage terminal, the first bias generator, and a reference voltage output terminal, and configured to control a reference voltage at the reference voltage output terminal according to the first bias voltage. The second driving component is coupled to the reference voltage output terminal, the second bias generator, and a resistance load, and configured to control a current between the reference voltage output terminal and the second driving component according to the second bias voltage, in which the first driving component and the second driving component are different types of transistors. The third bias generator is for generating a third bias voltage. The fourth bias generator is for generating a fourth bias voltage different from the third bias voltage. The third driving component is coupled to the resistance load, the third bias generator, and another reference voltage output terminal, and configured to control another reference voltage at the another reference voltage output terminal according to the third bias voltage. The fourth driving component is coupled to the another reference voltage output terminal, the fourth bias generator, and a low voltage terminal, and configured to control a current between the another reference voltage output terminal and the fourth driving component according to the fourth bias voltage, in which the third driving component and the fourth driving component are different types of transistors.

These and other objectives of the present invention will no doubt become obvious to those of ordinary skill in the art after reading the following detailed description of the exemplary embodiments that are illustrated in the various figures and drawings.

DETAILED DESCRIPTION OF THE PREFERRED EMBODIMENTS

The following description is written by referring to terms acknowledged in this industrial filed. If any term is defined in the description, such term should be explained accordingly. Besides, the connection between objects in the disclosed embodiments of this specification can be direct or indirect provided that these embodiments are still practicable under such connection. Said "indirect" indicates that an intermediate object or a physical space is existed between the objects. In addition, the shape, size, and ratio of any element in the disclosed drawings are just exemplary for understanding rather than restrictive for the present invention.

The present invention discloses a voltage reference buffer circuit using a plurality of driving components for enhancing the capability of souring and sinking current, and achieving the efficacy of prompt operation and low power consumption.

Figure 1:
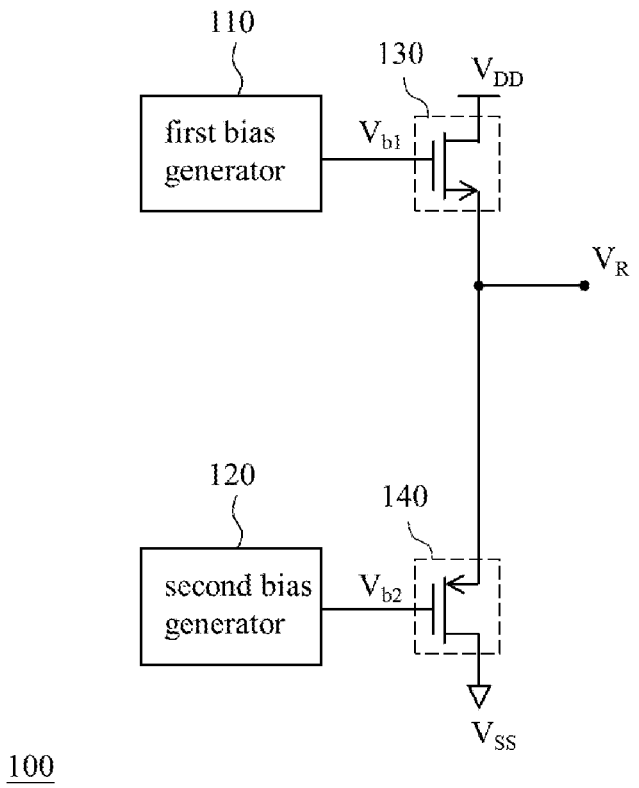
FIG. 1 illustrates an embodiment of the voltage reference buffer circuit of the present invention.

Please refer to FIG. 1 showing an embodiment of the voltage reference buffer circuit of the present invention. The voltage reference buffer circuit 100 of FIG. 1 includes a first bias generator 110, a second bias generator 120, a first driving component 130 and a second driving component 140. In this embodiment, the first driving component 130 and the second driving component 140 provide driving assistance concurrently under a normal state when a reference voltage is outputted; in other words, when the voltage reference buffer circuit 100 normally operates, the first driving component 130 and the second driving component 140 keep providing driving assistance. An embodiment of the first driving component 130 is a first transistor (e.g., an NMOS transistor or another type of transistor), and an embodiment of the second driving component 140 is a second transistor (e.g., a PMOS transistor or another type of transistor).

Figure 7:
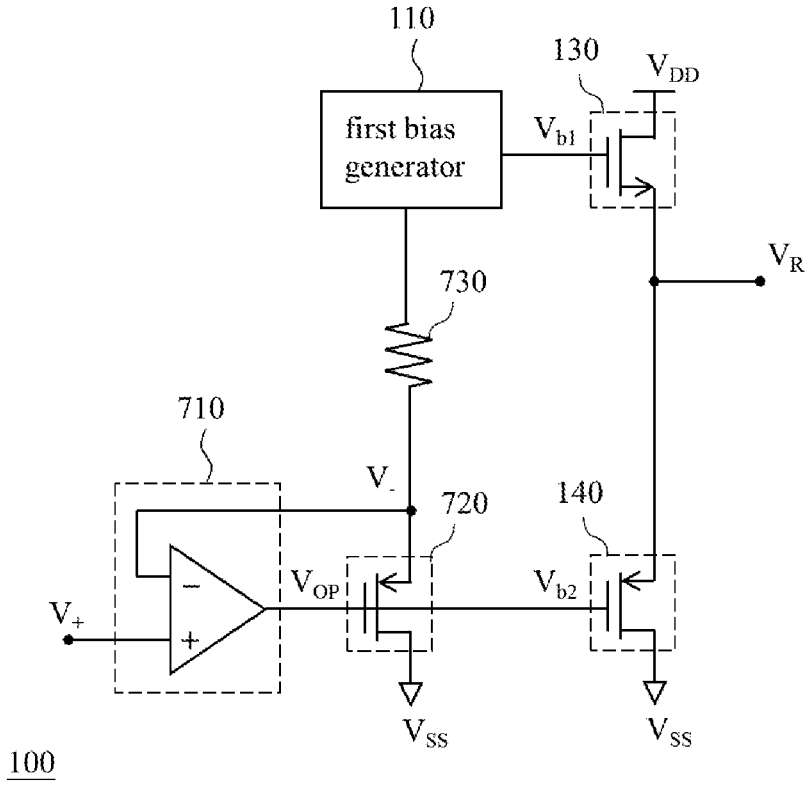
FIG. 7 illustrates another embodiment of the second bias generator of FIG. 1.

In detail, the first bias generator 110 is configured to generate a first bias voltage $V_{b1}$, and the second bias generator 120 is configured to generate a second bias voltage $V_{b2}$ that is different from the first bias voltage $V_{b1}$. The first driving component 130 includes three first electrodes (e.g., the drain, gate and source of an NMOS) that are connected to a high voltage terminal $V_{DD}$, the first bias generator 110 and a reference voltage output terminal $V_R$ respectively, and the first driving component 130 is configured to control a reference voltage at the reference voltage output terminal $V_R$ according to the first bias voltage $V_{b1}$. The second driving component 140 includes three second electrodes (e.g., the source, gate and drain of an PMOS) that are connected to the reference voltage output terminal $V_R$, the second bias generator 120 and a low voltage terminal $V_{SS}$ respectively, and the second driving component 140 is configured to control a current between the reference voltage output terminal $V_R$ and the second driving component 140 according to the second bias voltage $V_{b2}$. In an exemplary implementation of this embodiment, the first driving component 130 and the second driving component 140 are different types of transistors. In an exemplary implementation of this embodiment, a circuit composed of the first bias generator 110 and the first driving component 130 includes a first current mirror as shown in FIG. 2, and a circuit composed of the second bias generator 120 and the second driving component 140 includes a second current mirror as shown in FIG. 4 or FIG. 7.

Figure 2:
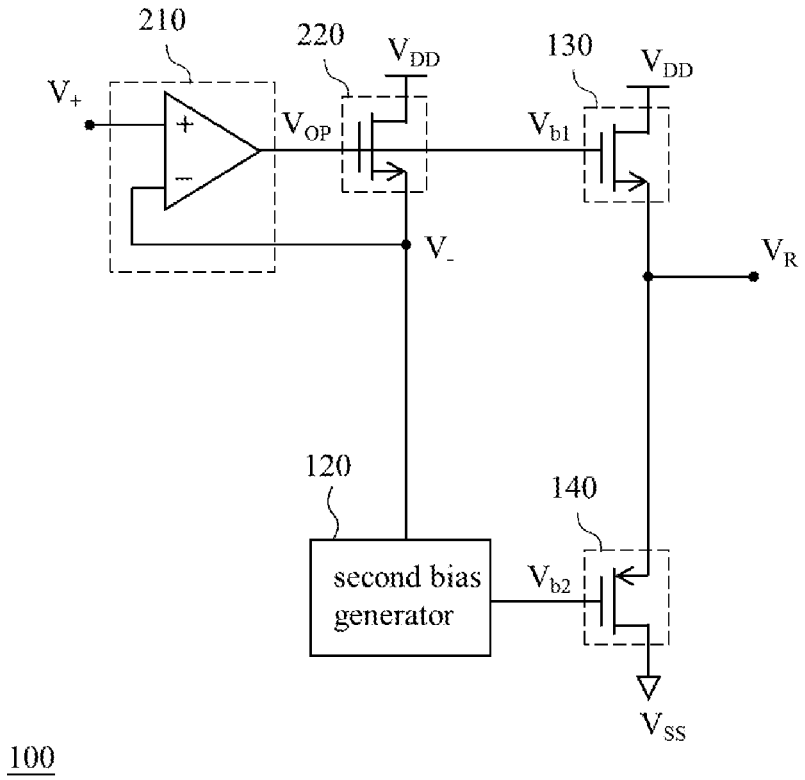
FIG. 2 illustrates an embodiment of the first bias generator of FIG. 1.

Please refer to FIG. 2 showing an embodiment of the first bias generator 110 of FIG. 1. As shown in FIG. 2, the first bias generator 110 includes a negative feedback circuit (e.g., an operational amplifier) 210 and a third driving component 220. The negative feedback circuit 210 includes a voltage input terminal $V_+$, a negative feedback circuit output terminal $V_{OP}$ and a negative feedback terminal $V_-$. The third driving component 220 is configured to control a voltage at the negative feedback terminal $V_-$ according to a voltage at the negative feedback circuit output terminal $V_{OP}$. In this embodiment, a terminal of the third driving component 220 is coupled to the negative feedback circuit output terminal $V_{OP}$, and this terminal is coupled to the first driving component 130 to form a first current mirror, furthermore, the voltage at the negative feedback circuit output terminal $V_{OP}$ is the first bias voltage $V_{b1}$, so that the first driving component 130 controls the reference voltage at the reference voltage output terminal $V_R$ according to the first bias voltage $V_{b1}$; in other words, by controlling the voltage (i.e., the first bias voltage $V_{b1}$) at the negative feedback circuit output terminal $V_{OP}$ and a conduction setting of the first driving component 130 (e.g., the voltage difference $V_{GS}$ between the gate and the source), the reference voltage at the reference voltage output terminal $V_R$ can be controlled.

Figure 3:
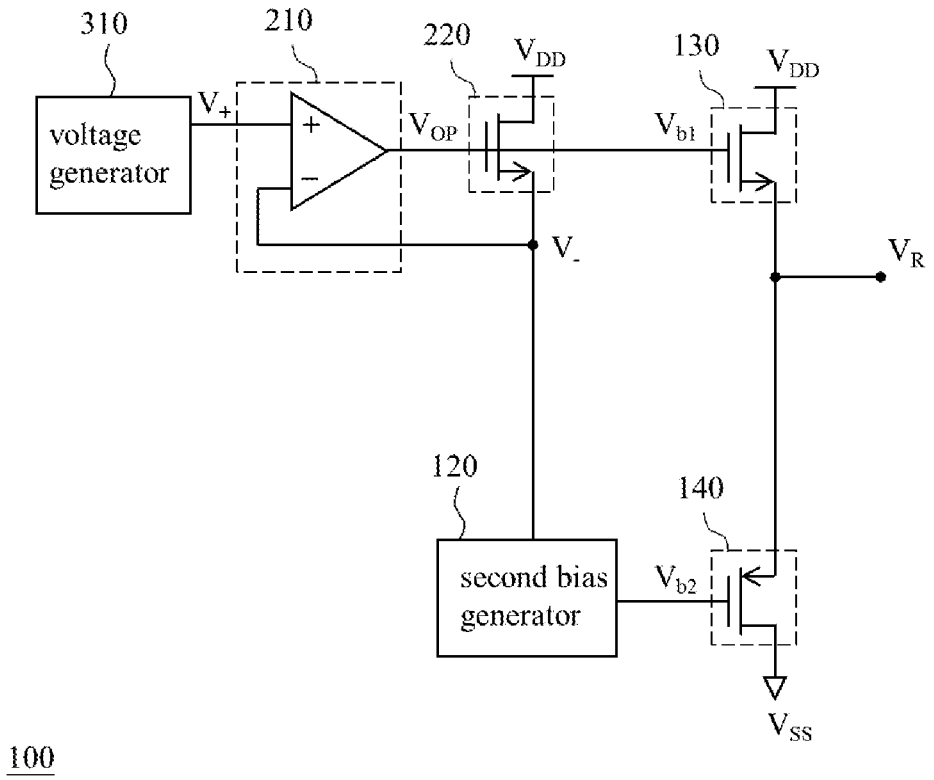
FIG. 3 illustrates another embodiment of the first bias generator of FIG. 1.

Please refer to FIG. 3 showing another embodiment of the first bias generator 110 of FIG. 1. In comparison with FIG. 2, the first bias generator 110 of FIG. 3 further includes a voltage generator 310 configured to provide a voltage at the voltage input terminal $V_+$ (while the circuit 310 is a constant voltage generator or an adjustable voltage generator) or configured to adjust and provide the voltage at the voltage input terminal $V_+$ (while the circuit 310 is an adjustable voltage generator). Since the voltage (i.e., the first bias voltage $V_{b1}$) at the negative feedback circuit output terminal $V_{OP}$ will approach the voltage at the voltage input terminal $V_+$ through a negative feedback mechanism, the voltage at the negative feedback circuit output terminal $V_{OP}$ can be controlled through the control over the voltage at the voltage input terminal $V_+$. People of ordinary skill in the art can appreciate that the voltage generator 310 can be realized with the existing arts such as a combination of a current source and a resistor, and thus the detail of the voltage generator 310 is omitted here.

Figure 4:
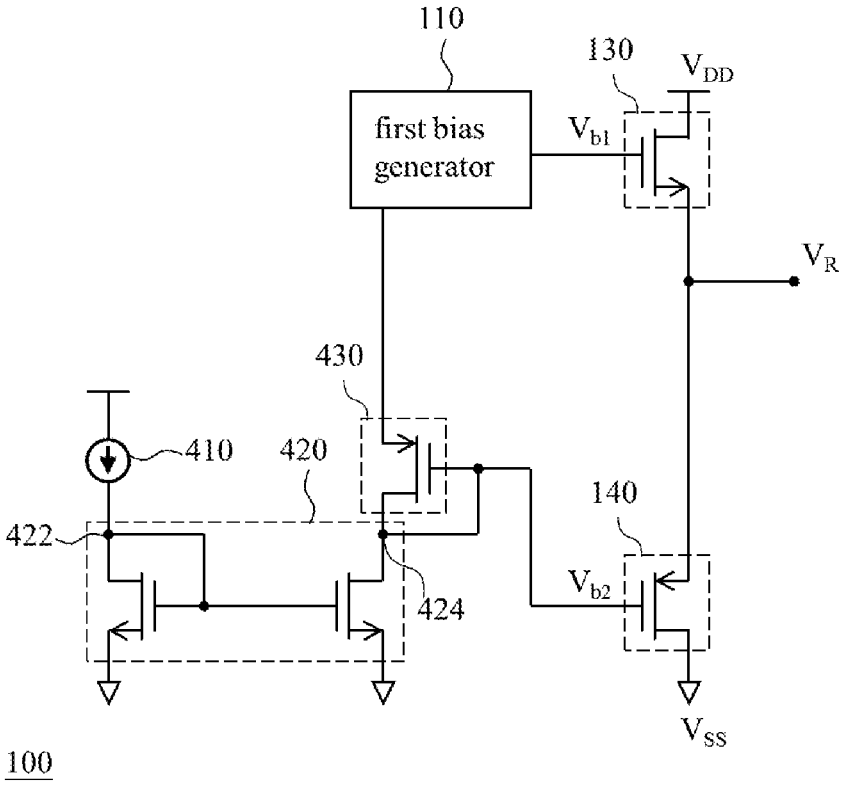
FIG. 4 illustrates an embodiment of the second bias generator of FIG. 1.

Please refer to FIG. 4 showing an embodiment of the second bias generator 120 of FIG. 1. The second bias generator 120 of FIG. 4 includes a current source 410, a current mirror circuit 420 and a fourth driving component 430. The current mirror circuit 420 includes a current source terminal 422 and a mirrored current terminal 424. The current source terminal 422 is coupled to the current source 410, and a voltage at the mirrored current terminal 424 is the second bias voltage $V_{b2}$. The fourth driving element 430 includes three fourth electrodes (e.g., the source, gate and drain of a PMOS) that are connected to the first bias generator 110 (e.g., the negative feedback terminal V_ of the first bias generator 110 in FIG. 3), the second bias component 140 and the mirrored current terminal 424 respectively. In this embodiment, the fourth driving component 430 is coupled to the second driving component 140 to form a second current mirror, so that the second driving component 140 controls the current between the reference voltage output terminal $V_R$ and the second driving component 140 according to the second bias voltage $V_{b2}$; in other words, since the current of the current source 410 is proportional to the current of the mirrored current terminal 424 and the current of the mirrored current terminal 424 is proportional to the current flowing through the second driving component 140, the current between the reference voltage output terminal $V_R$ and the second driving component 140 can be controlled by controlling the current of the current source 410. This current source 410 is a constant current source or an adjustable current source.

Figure 5:
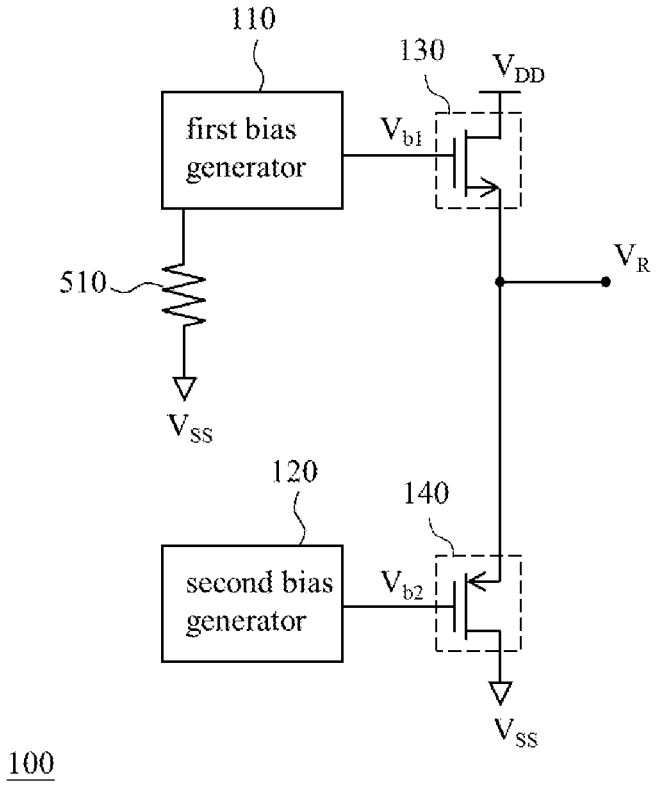
FIG. 5 illustrates another embodiment of the voltage reference buffer circuit of the present invention.

Please refer to FIG. 5. In an embodiment, in order to further control the first bias voltage $V_{b1}$ (e.g., the voltage at the negative feedback circuit output terminal $V_{OP}$ in FIG. 2), a resistance circuit 510 is set between the first bias generator 110 and the aforementioned low voltage terminal $V_{SS}$ (e.g., between the negative feedback terminal V_ and the low voltage terminal $V_{SS}$ in FIG. 2); however, this resistance circuit 510 is not a must for the present invention.

Figure 6:
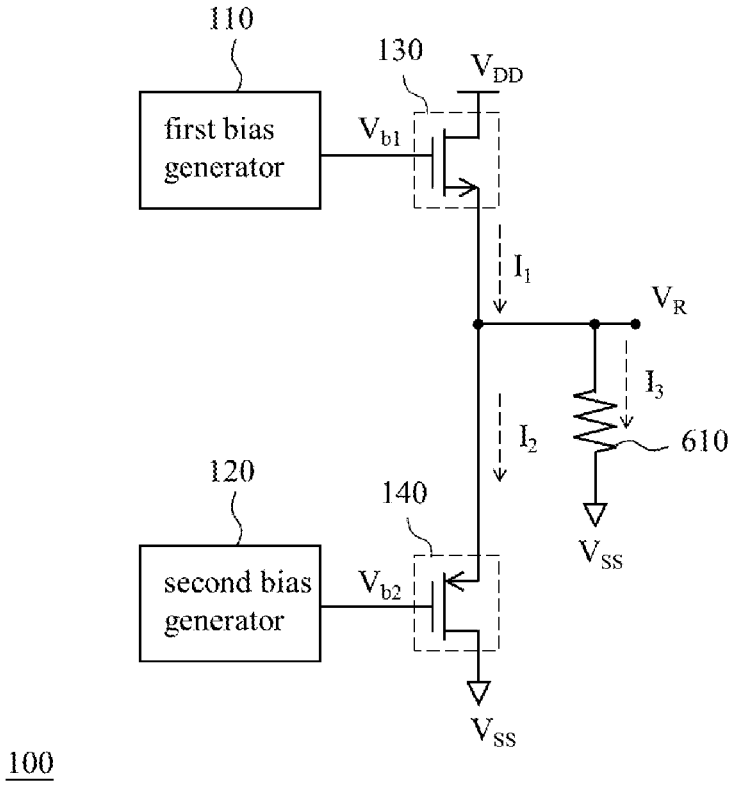
FIG. 6 illustrates a further embodiment of the voltage reference buffer circuit of the present invention.

Please refer to FIG. 6. In an embodiment, in order to further control the voltage at the reference voltage output terminal $V_R$, a resistance load 610 is set between the reference voltage output terminal $V_R$ and the low voltage terminal $V_{SS}$; however, this resistance load 610 is not a must for the present invention. In this embodiment, the resistance load 610 includes at least one resistor; when the resistance load 610 includes a plurality of resistors connected in series, the resistance load 610 provides the reference voltage at the reference voltage output terminal $V_R$ and at least one voltage division less than the reference voltage. If this embodiment is applied to a specific circuit such as a successive approximation register analog-to-digital converter (SAR ADC), a plurality of resistors with proper resistance values can be selected as the above-mentioned serially connected resistors, so as to make the reference voltage be $2^M$ times each of the at least one voltage division; however, this is an option rather than a limitation to the embodiment.

In an embodiment, in order to ensure the efficacy of the voltage reference buffer circuit 100, a current (I1) flowing through the first driving component 130 should be close to a current (I2) flowing through the second driving component 140. For instance, please refer to FIG. 6, the current (i.e., I2) between the reference voltage output terminal $V_R$ and the second driving component 140 should be greater than the current (I3) between the reference voltage output terminal $V_R$ and the resistance load 610, so as to have the current I1 be close to the current I2. In this instance, a resistance circuit with a higher resistance value is selected as the resistance load 610, so as to have the current I2 be equal to or greater than two times the current I3, or have the current I2 be equal to or greater than six times the current I3. The higher the ratio of the current I2 to the current I3 (i.e., I2/I3), the better the current driving capability (including current sinking capability) of the voltage reference buffer circuit 100. For another instance, as shown in FIG. 1 and FIG. 6, the ratio of the first driving component 130 (e.g., an NMOS transistor) to the second driving component 140 (e.g., a PMOS transistor) can be well controlled to have the current I1 be close to the current I2; more specifically, with proper design and/or fabrication, the ratio of the channel width of the second driving component 140 to the channel length of the second driving component 140 is N times the ratio of the channel width of the first driving component 130 to the channel length of the first driving component 130, in which the N is a positive number (e.g., a number between two and four, or a number equal or close to three).

FIG. 7 shows another embodiment of the second bias generator 120 of FIG. 1. The second bias generator 120 of FIG. 7 includes a negative feedback circuit 710 and a fourth driving component 720. The negative feedback circuit 710 includes a voltage input terminal $V_+$, a negative feedback circuit output terminal $V_{OP}$ and a negative feedback terminal V_, in which the negative feedback terminal V_ is coupled to the first bias generator 110 (e.g., coupled to the negative feedback terminal V_ of the first bias generator 110 in FIG. 2). The fourth driving component 720 is coupled to the negative feedback terminal V_, the negative feedback circuit output terminal $V_{OP}$ and a low voltage terminal $V_{SS}$, and configured to control a voltage at the negative feedback terminal V_ according to a voltage at the negative feedback circuit output terminal $V_{OP}$ (i.e., the second bias voltage $V_{b2}$). In this embodiment, a terminal of the fourth driving component 720 is coupled to the negative feedback circuit output terminal $V_{OP}$, and this terminal is also coupled to the second driving component 140 to form a second current mirror, so that the current flowing through the fourth driving component 720 is proportional to the current flowing through the second driving component 140. Accordingly, the second driving component 140 can control a current between the reference voltage output terminal $V_R$ and the second driving component 140 according to the voltage at the negative feedback circuit output terminal $V_{OP}$ (i.e., the second bias voltage $V_{b2}$) that is determined by the voltage at the voltage input terminal $V_+$.

FIG. 7 further includes a resistance circuit 730 that is coupled between the first bias generator 110 and the negative feedback terminal V_. The resistance circuit 730 is configured to further control the voltage at the negative feedback terminal V_ and the current flowing through the fourth driving component 720. It should be noted that the resistance circuit 730 is an option instead of a must.

Figure 8:
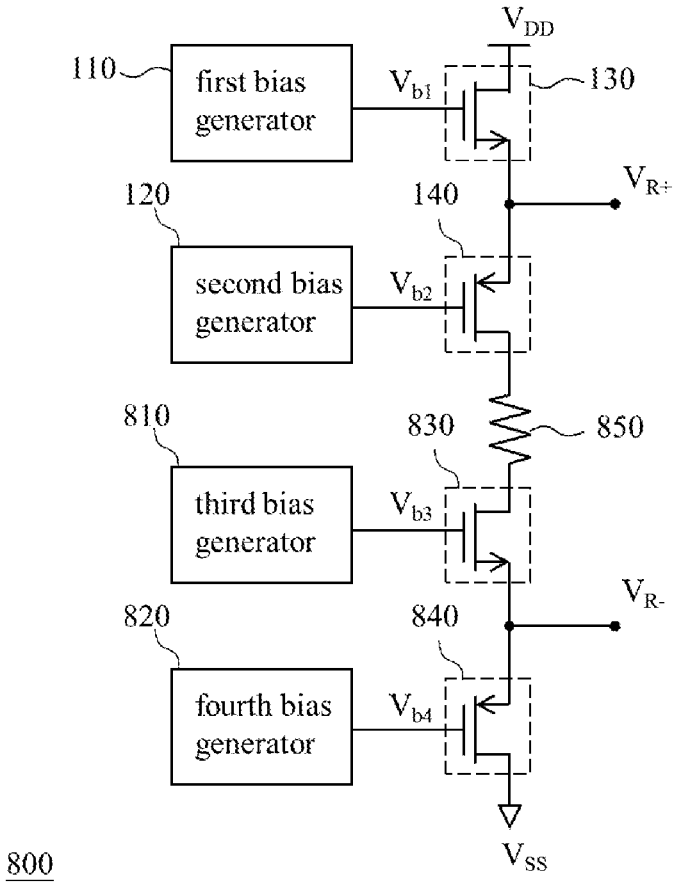
FIG. 8 illustrates a further embodiment of the voltage reference buffer circuit of the present invention.

Please refer to FIG. 8 showing another embodiment of the voltage reference buffer circuit of the present invention. As shown in FIG. 8, in order to provide two reference voltages for a specific circuit (e.g., SAR ADC), the voltage reference buffer circuit 800 includes the aforementioned first bias generator 110, second bias generator 120, first driving component 130 and second driving component 140 for providing a reference voltage $V_{R+}$, and the voltage reference buffer circuit 800 further includes a third bias generator 810, a fourth bias generator 820, a third driving component 830 and a fourth driving component 840 for providing another reference voltage $V_{R-}$, in which the third bias generator 810 provides a third bias voltage $V_{b3}$, the fourth bias generator 820 provides a fourth bias voltage $V_{b4}$ different from the third bias voltage $V_{b3}$, and the third driving component 830 and the fourth driving component 840 are different types of transistors. In addition, the voltage reference buffer circuit 800 includes a resistance load 850 coupled between the second driving component 140 and the third driving component 830 for defining the two different reference voltages $V_{R+}$, $V_{R-}$.

Since those of ordinary skill in the art can apply a feature of any of the aforementioned embodiments to the other embodiments in a reasonable way, repeated and redundant description is therefore omitted.

Figure 9:
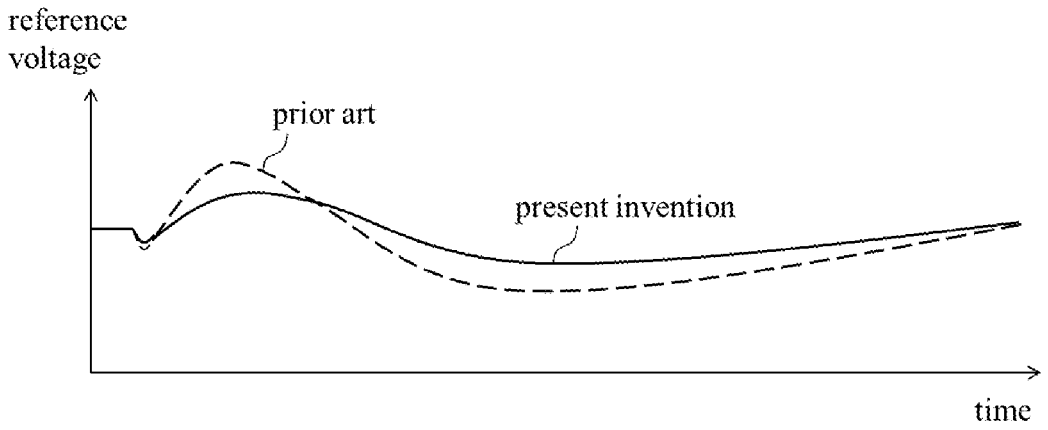
FIG. 9 illustrates the comparison of current sink capability between the present invention and a prior art.
Figure 10:
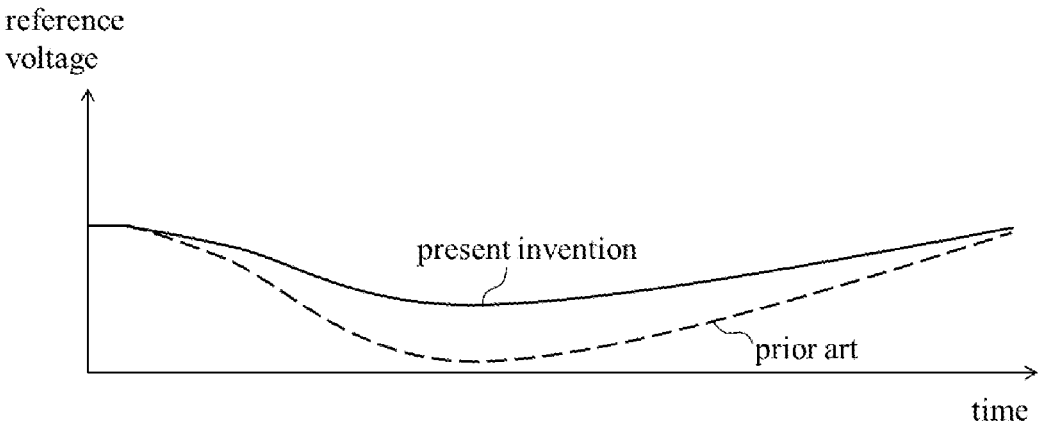
FIG. 10 illustrates the comparison of current source capability between the present invention and a prior art.

To sum up, the present invention uses a plurality of driving components for enhancing the capability of sourcing and sinking current, and thereby establishes or recover a reference voltage instantly. For instance, as shown in FIG. 9, in comparison with a known voltage reference buffer, after drawing current the present invention recovers a reference voltage (, that is to say making the reference voltage rise first and fall afterwards,) at a faster speed; this is because after connecting to a voltage reference reception circuit (e.g., SAR ADC), the present invention (with the setting of the aforementioned second driving component) can draw more current from the voltage reference reception circuit to recover the reference voltage quickly as shown by the solid line in FIG. 9. On the other hand, the known voltage reference buffer, especially the resistance load therein for establishing the reference voltage, draws less current from the voltage reference reception circuit and thus the reference voltage will be recovered at a slower speed as shown by the dash line in FIG. 9. For another instance, as shown in FIG. 10, after outputting current the present invention recovers a reference voltage (, that is to say making the reference voltage fall first and rise afterwards,) at a faster speed, this is because after connecting to a voltage reference reception circuit (e.g., SAR ADC), the present invention (with the setting of the aforementioned second driving component) can output more current to the voltage reference reception circuit to recover the reference voltage quickly as shown by the solid line in FIG. 10. On the other hand, the known voltage reference buffer, especially the resistance load therein for establishing the reference voltage, outputs less current to the voltage reference reception circuit and thus the reference voltage will be recovered at a slower speed as shown by the dash line in FIG. 10. Since those of ordinary skill in the art can appreciate the characteristics and advantages of the present invention in accordance with the configuration of the present invention, unnecessary explanation is omitted.

The aforementioned descriptions represent merely the exemplary embodiments of the present invention, without any intention to limit the scope of the present invention thereto. Various equivalent changes, alterations, or modifications based on the claims of the present invention are all consequently viewed as being embraced by the scope of the present invention.

What is claimed is:

1. A voltage reference buffer circuit, comprising:

a first bias generator for generating a first bias voltage;

a second bias generator for generating a second bias voltage different from the first bias voltage;

a third bias generator for generating a third bias voltage;

a fourth bias generator for generating a fourth bias voltage different from the third bias voltage;

a first driving component coupled to a high voltage terminal, the first bias generator, and a reference voltage output terminal, and configured to control a reference voltage at the reference voltage output terminal according to the first bias voltage;

a second driving component coupled to the reference voltage output terminal, the second bias generator, and a resistance load, and configured to control a current between the reference voltage output terminal and the second driving component according to the second bias voltage, in which the first driving component and the second driving component are different types of transistors;

a third driving component coupled to the resistance load, the third bias generator, and another reference voltage output terminal, and configured to control another reference voltage at the another reference voltage output terminal according to the third bias voltage; and a fourth driving component coupled to the another reference voltage output terminal, the fourth bias generator, and a low voltage terminal, and configured to control a current between the another reference voltage output terminal and the fourth driving component according to the fourth bias voltage, in which the third driving component and the fourth driving component are different types of transistors.

2. The voltage reference buffer circuit of claim 1, wherein the first driving component is set between the high voltage terminal and the reference voltage output terminal; the second driving component is set between the reference voltage output terminal and the resistance load; a voltage at a source terminal of the first driving component and a voltage at a source terminal of the second driving component are equal to the reference voltage; the third driving component is set between the resistance load and the another reference voltage output terminal; the fourth driving component is set between the another reference voltage output terminal and the low voltage terminal; a voltage at a source terminal of the third driving component and a voltage at a source terminal of the fourth driving component are equal to the another reference voltage.

3. The voltage reference buffer circuit of claim 1, wherein the first bias generator includes:

a negative feedback circuit including a voltage input terminal, a negative feedback circuit output terminal and a negative feedback terminal, the negative feedback circuit receiving a voltage with the voltage input terminal; and a fifth driving component coupled to the high voltage terminal, the negative feedback circuit output terminal, and the negative feedback terminal, and configured to control a voltage at the negative feedback terminal according to a voltage at the negative feedback circuit output terminal, in which a terminal, that is coupled to the negative feedback circuit output terminal, of the fifth driving component is coupled to the first driving component to form a first current mirror, and the voltage at the negative feedback circuit output terminal is the first bias voltage.

4. The voltage reference buffer circuit of claim 1, wherein the second bias generator includes:

a current source;

a current mirror circuit including a current source terminal and a mirrored current terminal, in which the current source terminal is coupled to the current source and a voltage at the mirrored current terminal is the second bias voltage; and a sixth driving component coupled to the negative feedback terminal, the second driving component and the mirrored current terminal, the sixth driving component coupled to the second driving component to form a second current mirror.

5. The voltage reference buffer circuit of claim 1, wherein the second bias generator includes:

a negative feedback circuit including a voltage input terminal, a negative feedback circuit output terminal, and a negative feedback terminal, and receiving a voltage with the voltage input terminal, in which the negative feedback terminal is coupled to the first bias generator via a resistor; and a sixth driving component coupled to the negative feedback terminal, the negative feedback circuit output terminal, and the low voltage terminal, and configured to control a voltage at the negative feedback terminal according to a voltage at the negative feedback circuit output terminal, in which a terminal, that is coupled to the negative feedback circuit output terminal, of the sixth driving component is coupled to the second driving component to form a second current mirror, and the voltage at the negative feedback circuit output terminal is the second bias voltage.

6. The voltage reference buffer circuit of claim 1, wherein the third bias generator includes:

a negative feedback circuit including a voltage input terminal, a negative feedback circuit output terminal and a negative feedback terminal, the negative feedback circuit receiving a voltage with the voltage input terminal; and a seventh driving component coupled to the high voltage terminal, the negative feedback circuit output terminal, and the negative feedback terminal, and configured to control a voltage at the negative feedback terminal according to a voltage at the negative feedback circuit output terminal, in which a terminal, that is coupled to the negative feedback circuit output terminal, of the seventh driving component is coupled to the third driving component to form a third current mirror, and the voltage at the negative feedback circuit output terminal is the third bias voltage.

7. The voltage reference buffer circuit of claim 1, wherein the fourth bias generator includes:

a current source;

a current mirror circuit including a current source terminal and a mirrored current terminal, in which the current source terminal is coupled to the current source and a voltage at the mirrored current terminal is the fourth bias voltage; and an eighth driving component coupled to the negative feedback terminal, the fourth driving component, and the mirrored current terminal, in which the eighth driving component is coupled to the fourth driving component to form a fourth current mirror.

8. The voltage reference buffer circuit of claim 1, wherein the fourth bias generator includes:

a negative feedback circuit including a voltage input terminal, a negative feedback circuit output terminal, and a negative feedback terminal, and receiving a voltage with the voltage input terminal, in which the negative feedback terminal is coupled to the third bias generator via a resistor; and an eighth driving component coupled to the negative feedback terminal, the negative feedback circuit output terminal, and the low voltage terminal, and configured to control a voltage at the negative feedback terminal according to a voltage at the negative feedback circuit output terminal, in which a terminal, that is coupled to the negative feedback circuit output terminal, of the eighth driving component is coupled to the fourth driving component to form a fourth current mirror, and the voltage at the negative feedback circuit output terminal is the fourth bias voltage.

* * * * *